US009410250B2

(12) United States Patent
Yoshizawa et al.

(10) Patent No.: US 9,410,250 B2
(45) Date of Patent: Aug. 9, 2016

(54) DISCHARGE SURFACE TREATMENT ELECTRODE AND METHOD OF MANUFACTURING THE SAME

(75) Inventors: Hiroki Yoshizawa, Tokyo (JP); Satoshi Kurita, Tokyo (JP); Mitsutoshi Watanabe, Tokyo (JP); Kyouhei Nomura, Tokyo (JP); Yukihiro Shimoda, Tokyo (JP); Nobuhiko Yunoki, Tokyo (JP); Masanobu Hasegawa, Tokyo (JP)

(73) Assignee: IHI Corporation, Tokyo (JP)

( * ) Notice: Subject to any disclaimer, the term of this patent is extended or adjusted under 35 U.S.C. 154(b) by 1337 days.

(21) Appl. No.: 13/264,002

(22) PCT Filed: Apr. 13, 2010

(86) PCT No.: PCT/JP2010/056593

§ 371 (c)(1),
(2), (4) Date: Oct. 12, 2011

(87) PCT Pub. No.: WO2010/119865

PCT Pub. Date: Oct. 21, 2010

(65) Prior Publication Data

US 2012/0037070 A1 Feb. 16, 2012

(30) Foreign Application Priority Data

Apr. 14, 2009 (JP) ..... 2009-097683

(51) Int. Cl.
*B22F 3/02* (2006.01)
*C23C 26/00* (2006.01)
(Continued)

(52) U.S. Cl.
CPC ..... *C23C 26/00* (2013.01); *B22F 1/0007* (2013.01); *C22C 19/07* (2013.01);
(Continued)

(58) Field of Classification Search
CPC ... B22F 9/082; B22F 1/0007; B22F 2009/044
See application file for complete search history.

(56) References Cited

U.S. PATENT DOCUMENTS 5,770,310 A * 6/1998 Noguchi et al. ..... 428/403
5,950,063 A 9/1999 Hens et al.
(Continued)

FOREIGN PATENT DOCUMENTS

CN 1314832 A 9/2001
CN 1798870 A 7/2006
(Continued)

OTHER PUBLICATIONS

International Search Report issued May 25, 2010 in PCT/JP10/056593 filed Apr. 13. 2010.
(Continued)

*Primary Examiner* — George Wyszomierski
*Assistant Examiner* — Ngoclan T Mai
(74) *Attorney, Agent, or Firm* — Oblon, McClelland, Maier & Neustadt, L.L.P.

(57) ABSTRACT

A discharge surface treatment electrode used in discharge surface treatment for forming a wear-resistant film on a treatment target surface of a workpiece by use of the discharge energy of electric discharges caused between the electrode and the workpiece, the film being made of a material of an electrode or a substance obtained by a reaction of the material of the electrode with the discharge energy. The discharge surface treatment electrode is formed by: compression-molding a mixed powder into a green compact, the mixed powder being formed from a powder of a Stellite alloy with an average particle size of 3 μm or less prepared by use of a jet mill and a powder of a metal with an average particle size of 3 μm or less manufactured through an atomization process or a chemical process; and subjecting the green compact to heat treatment.

6 Claims, 4 Drawing Sheets

(51) Int. Cl.

| | |
|---|---|
| ***B22F 1/00*** | (2006.01) |
| ***C22C 19/07*** | (2006.01) |
| ***C22C 33/02*** | (2006.01) |
| ***C22C 38/30*** | (2006.01) |
| *B22F 9/08* | (2006.01) |
| *B22F 9/30* | (2006.01) |
| *C22C 19/03* | (2006.01) |
| *C22C 19/05* | (2006.01) |
| *B22F 9/04* | (2006.01) |
| *B22F 9/02* | (2006.01) |

(52) U.S. Cl.

CPC ..... *C22C 33/0207* (2013.01); *C22C 38/30* (2013.01); *B22F 9/026* (2013.01); *B22F 9/082* (2013.01); *B22F 9/305* (2013.01); *B22F 2009/044* (2013.01); *B22F 2998/10* (2013.01); *C22C 19/03* (2013.01); *C22C 19/051* (2013.01)

(56) References Cited

U.S. PATENT DOCUMENTS

| | | | | |
|---|---|---|---|---|
| 6,365,008 | B1 | 4/2002 | Goto et al. | |
| 2005/0211165 | A1 | 9/2005 | Goto et al. | |
| 2006/0081462 | A1 | 4/2006 | Goto et al. | |
| 2006/0086617 | A1* | 4/2006 | Goto et al. | 205/102 |
| 2007/0068793 | A1 | 3/2007 | Goto et al. | |
| 2008/0267806 | A1* | 10/2008 | Suetsuna | B22F 9/22 419/35 |
| 2009/0092845 | A1* | 4/2009 | Goto et al. | 428/457 |
| 2009/0127110 | A1 | 5/2009 | Teramoto et al. | |
| 2012/0056133 | A1 | 3/2012 | Teramoto et al. | |

FOREIGN PATENT DOCUMENTS

| | | | |
|---|---|---|---|
| CN | 101374975 | A | 2/2009 |
| EP | 1 645 659 | A1 | 4/2006 |
| EP | 2 017 370 | A1 | 1/2009 |
| JP | 2005-213560 | A | 8/2005 |
| JP | 2007 23365 | | 2/2007 |
| JP | 2007-307565 | A | 11/2007 |
| JP | 2008 240067 | | 10/2008 |
| WO | 2004 106587 | | 12/2004 |
| WO | 2008 032359 | | 3/2008 |

OTHER PUBLICATIONS

Combined Chinese Office Action and Search Report Issued Apr. 11, 2013 in Patent Application No. 201080016028.4 (with English translation of Categories of Cited Documents).

Office Action issued Dec. 20, 2012, in Russian Patent Application No. 2011146079/02(068971) with English translation.

Mitin B. S., Powder Metallurgy and Sprayed Coatings, Moscow, Metallurgy, 1987, pp. 41-46, 57, 81, 82 and 98.

Extended European Search Report issued Oct. 14, 2013, in Patent Application No. 10764449.4.

* cited by examiner

DISCHARGE SURFACE TREATMENT ELECTRODE AND METHOD OF MANUFACTURING THE SAME

TECHNICAL FIELD

The present invention relates to a discharge surface treatment electrode and a method of manufacturing the same.

BACKGROUND ART

International Publication No. WO2004/106587 discloses various electrodes as discharge surface treatment electrodes that are used in discharge surface treatment to form a wear-resistant film on a treatment target portion of a workpiece.

SUMMARY OF INVENTION

Technical Problem

The foregoing conventional technique improves the hardness uniformity and density of an electrode. However, the technique does not take good account of the deposition efficiency or film-forming rate in discharge surface treatment using this electrode. Hence, it is difficult to improve the productivity of the film. Here, the deposition efficiency means a ratio of the thickness of a film formed on a treatment target surface of a workpiece to the feeding amount of a discharge surface treatment electrode (the thickness of a formed film/the feeding amount of the discharge surface treatment electrode). The film-forming rate means the thickness of a film formed per unit time.

The present invention has been made in view of the above problem, and an object thereof is to provide a highly-productive discharge surface treatment electrode enabling the formation of a film at a higher deposition efficiency and a higher film-forming rate to achieve high productivity, and a method of manufacturing the electrode.

Solution to Problem

A first aspect of the present invention is a discharge surface treatment electrode used in discharge surface treatment for forming a wear-resistant film, which is made of a material of an electrode or a substance obtained by a reaction of the material of the electrode with discharge energy, on a treatment target surface of a workpiece by use of the discharge energy which is obtained by causing electric discharges between the electrode and the workpiece, wherein the discharge surface treatment electrode is formed by: compression-molding a mixed powder into a green compact, the mixed powder being formed from a powder of a Stellite alloy with an average particle size of 3 μm or less prepared by use of a jet mill and a powder of a metal with an average particle size of 3 μm or less manufactured through an atomization process or a chemical process; and subjecting the green compact to heat treatment.

A second aspect of the present invention is a method of manufacturing a discharge surface treatment electrode used in discharge surface treatment for forming a wear-resistant film, which is made of a material of an electrode or a substance obtained by a reaction of the material of the electrode with discharge energy, on a treatment target surface of a workpiece by use of the discharge energy which is obtained by causing electric discharges between the electrode and the workpiece, the method including: a slurry preparation step of preparing a slurry by mixing at least a powder of a Stellite alloy with an average particle size of 3 μm or less prepared by use of a jet mill, a powder of a metal with an average particle size of 3 μm or less manufactured through an atomization process or a chemical process, and a solvent; a granular powder preparation step of preparing granular powder by drying the solvent in the slurry after the slurry preparation step; a green compact preparation step of compression-molding a green compact out of the granular powder after the granular powder preparation step; and a heat treatment step of sintering the green compact by subjecting the green compact to heat treatment after the green compact preparation step.

DESCRIPTION OF EMBODIMENTS

Figure 1:
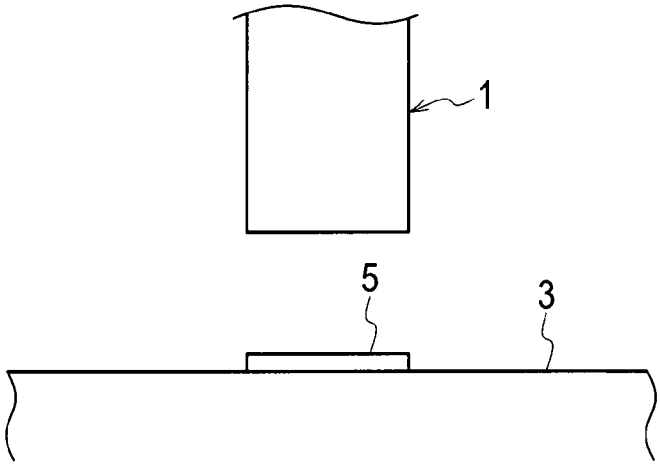
FIG. 1 is a diagram for describing a discharge surface treatment electrode in an embodiment of the present invention.

Hereinbelow, a preferred embodiment of the present invention will be described by referring to the drawings. The technical scope of the present invention should be defined on the basis of what is described in the scope of claims, and is not limited solely to the following embodiment. Meanwhile, in description of the drawings, the same elements are denoted by the same reference numerals, and duplicate description will be omitted. Moreover, dimensional ratios in the drawings are exaggerated for the sake of explanatory convenience, and may be different from the actual ratios.

As shown in FIG. 1, a discharge surface treatment electrode 1 in the embodiment of the present invention is used in discharge surface treatment for forming a wear-resistant film 5, which is made of the material of the electrode (hereinafter referred to as a "electrode material") or a substance obtained by a reaction of the electrode material with discharge energy, on a treatment target surface of a workpiece (base material) 3 by use of the discharge energy of electric discharges caused between the electrode 1 and the workpiece 3 in a working liquid such as an electrically-insulating oil or in the air. Moreover, the discharge surface treatment electrode 1 is obtained by subjecting a green compact (molded body) 9 shown in FIG. 2, which is compression-molded out of a metal powder 7, to heat treatment.

In this respect, the metal powder 7 is powder (hereinafter, referred to as mixed power 7) of a mixture of a stellite powder with an average particle size of 3 μm or less prepared by use of a jet mill (hereinafter, referred to as jet-milled stellite powder) and a metal powder with an average particle size of 3 μm or less manufactured through an atomization process or a chemical process (hereinafter, referred to as atomization-process/chemical-process metal powder).

Stellite (a registered trademark of Deloro Stellite Company) is a range of alloys essentially containing cobalt, and consisting of chromium, nickel, tungsten, and the like. Typical examples of the stellite include stellite 1, stellite 3, stellite 4, stellite 6, stellite 7, stellite 12, stellite 21 and stellite F.

Examples of the powder metal in the atomization-process/chemical-process metal powder include: alloys such as an iron-based alloy, a nickel (Ni) alloy, and a cobalt (Co) alloy; pure metals such as iron (Fe), cobalt (Co), nickel (Ni), copper (Cu), chromium (Cr), and molybdenum (Mo); and Stellite alloys.

Examples of the iron-based alloy include: an alloy essentially containing iron and nickel; an alloy essentially containing iron, nickel and cobalt; and an alloy essentially containing iron, nickel and chromium. Examples of the alloy essentially containing iron, nickel, and chromium include a stainless steel, typical examples of which include SUS304, SUS316, and the like specified by the Japanese Industrial Standards.

Examples of the nickel alloy include Hastelloy (a registered trademark of Haynes International Inc.) alloys, Inconel (a registered trademark of Special Metals Corporation) alloys, Incoloy (a registered trademark of Special Metals Corporation) alloys, Monel (a registered trademark of Special Metals Corporation) alloys, Nimonic (a registered trademark of Special Metals Corporation) alloys, RENE (a registered trademark of Teledyne Industries Inc) alloys, UDIMET (a registered trademark of Special Metals Corporation) alloys, and the WASPALOY (United Technologies Corporation) alloy.

Examples of the cobalt alloy include stellite-based alloys, Tribaloy-based alloys (TRIBALOY T400 or T800 (TRIBALOY is a registered trademark of Deloro Stellite Company)) and UDIMET 700 (registered trademark of Special Metals Corporation).

The jet mill is configured to cause powder particles to collide with one another by jetting the particles from nozzles opposed to each other at a supersonic speed or a transonic speed, and thus to pulverize and micronize the powder particles into the powder with nonspherical particle shapes. The ground powder has polyhedral particle shapes each with a number of corners formed randomly on its surface. Moreover, since the jet mill grinds the powder in an oxidizing atmosphere, the ground powder contains 6 to 14% by weight of oxygen.

The atomization process is a process for obtaining powder by causing a jet of an inert gas or the like to collide with a metal melt flowing out of a tundish to thereby break the metal melt into droplets and solidify the droplets. In general, powder manufactured by the atomization process has substantially spherical particle shapes.

Examples of the chemical process include a carbonyl process, and a reduction process. A carbonyl iron powder, a carbonyl cobalt powder, and a carbonyl nickel powder can be manufactured by the carbonyl process. A molybdenum powder can be manufactured by the reduction process. Note that the carbonyl process has an advantage that the particle shape is controllable.

The average particle size means a particle size lying at a midpoint of the distribution (median) of particle sizes measured by a laser diffraction/scattering method where accumulated distribution in an ascending order from the smallest particle size is 50%. The laser diffraction/scattering method utilizes the fact that an amount of scattering light and a scattering pattern vary from one particle size to another when a laser ray is cast on particles. The distributions are obtained by casting a laser ray on the particles moving in a liquid for several tens of thousands of times in 30 seconds and counting the results. So, averaged data can be obtained.

In general, many discharge surface treatment electrodes are molded out of a powder with an average particle size of 10 nm to several micrometers. However, the average particle sizes of the jet-milled stellite powder and the atomization-process/chemical-process metal powder in the discharge surface treatment electrode 1 are each preferably 3 μm or less. The average particle size within such a range makes it easier to manufacture a uniformly compressed green compact 9 in a green compact preparation step to compression-mold the mixed powder 7 into the green compact 9, which will be described later. The average particle size also makes it possible to obtain a uniformly dense electrode in a subsequent heat treatment step to turn the green compact 9 into the discharge surface treatment electrode 1 by sintering the green compact 9, which will be described later.

Meanwhile, in order to efficiently form a homogeneous film through discharge surface treatment using a discharge surface treatment electrode, it is important that the electrode material should be melted and transferred onto the workpiece uniformly (without creating any local unevenness) at a constant rate by use of the energy of an electric discharge caused between the electrode and the workpiece. When the average particle size of the atomization-process/chemical-process metal powder is extremely larger than the average particle size of the jet-milled stellite powder, such a difference locally or entirely breaks the balance in the amount of heat necessary for the discharge energy to locally melt the electrode material, and lowers the deposition efficiency and the film-forming rate. In view of this, the average particle sizes of the jet-milled stellite powder and the atomization-process/chemical-process metal powder in the discharge surface treatment electrode 1 are each preferably 3 μm or less.

In order for the discharge surface treatment electrode 1 to have strength necessary for electric discharges, it is preferable to set the tap density of the mixed powder 7 in a range of 3.0 to 5.0 g/cm$^3$. On the other hand, in order to secure a stable shape for the discharge surface treatment electrode 1, it is preferable to add 10% by weight or more of ground powder having a tap density of 0.5 to 1.0 g/com$^3$. Note that: the tap density means the density of powder after it is vibrated or tapped on its surface several times; and the tap density can be measured using an existing tap density measurement apparatus.

No specific restriction is imposed on the mixing ratio by weight of the jet-milled stellite powder to the atomization-process/chemical-process metal powder. In order for the discharge surface treatment electrode 1 to have electric conductivity necessary for the electric discharges, the mixing ratio by weight of the jet-milled stellite powder to the atomization-process/chemical-process metal powder should preferably fall within, but not limited to, a range from 5:5 to 1:9 (the atomization-process/chemical-process metal powder is 50 to 90% by weight), more preferably from 4:6 to 2:8 (the atomization-process/chemical-process metal powder is to 80% by weight), and yet more preferably 3:7 (the atomization-process/chemical-process metal powder is approximately 70% by weight).

Figure 2:
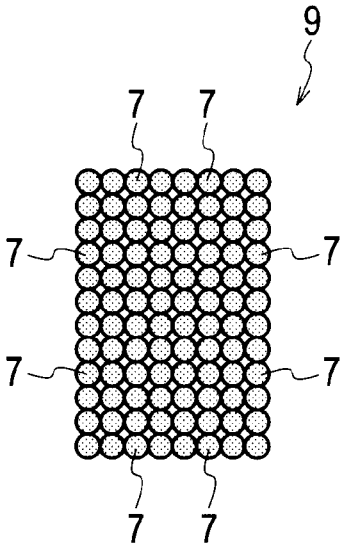
FIG. 2 is a diagram showing a green compact for the discharge surface treatment electrode in FIG. 1.
Figure 3:
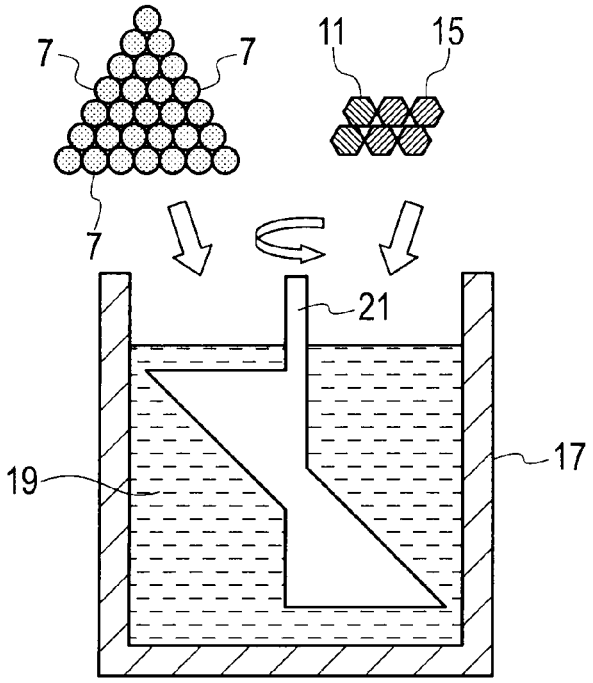
FIG. 3 is a diagram for describing a slurry preparation step in a method of manufacturing the discharge surface treatment electrode in FIG. 1.

The green compact 9 is a molded body which is compression-molded out of the mixed powder 7, as shown in FIG. 2. The green compact 9 turns into the discharge surface treatment electrode 1 by heat treatment. Besides the mixed powder 7, the green compact 9 may contain polypropylene (PP) as a binder 11, and stearic acid as a lubricant 15, as shown in FIG. 3.

The binder 11 is added to enhance the compression-moldability of the mixed powder 7 and therefore to improve the shape retainability of the green compact 9. In this embodiment, polypropylene (PP) is used as a main component of the binder 11. However, the main component is not limited thereto, and may be a plastic resin such as polyethylene (PE), polymethyl methacrylate (PMMA), or polyvinyl alcohol (PVA). Alternatively, the main component may be a polysaccharide substance such as agar in a case of a gel-forming substance. It is preferable to employ a general-purpose plastic that is highly volatile and has a relatively small amount of residual components.

Approximately 1 to 10% by weight of the lubricant 15 is added in order to enhance the flowability of the mixed powder 7 and therefore to achieve excellent transfer of the pressure of a press at the time of the compression molding. In this embodiment, stearic acid is used for the lubricant 15. However, the lubricant 15 is not limited thereto, and may be a wax such as paraffin wax or zinc stearate.

A method of manufacturing a discharge surface treatment electrode in the embodiment of the present invention is a method of manufacturing the discharge surface treatment electrode 1, and includes (i) a slurry preparation step, (ii) a granular powder preparation step, (iii) a green compact preparation step, and (iv) a heat treatment step, which are described below in detail.

(i) Slurry Preparation Step

As shown in FIG. 3, the mixed powder 7, the binder 11, and the lubricant 15 are mixed into a solvent 19 stored in a tank 17. The binder 11 is preferably added by 2 to 10% by weight. Examples of the solvent 19 include: alcohols such as ethanol, propanol, and butanol; and organic solvents such as acetone, toluene, xylene, benzene, and normal hexane. Water may be used as the solvent if the binder 11 is a water-soluble substance such as polyvinyl alcohol (PVA) or agar. An agitator 21 disposed inside the tank 17 is then rotated about its vertical shaft to thereby agitate the inside of the tank 17. As a result, a slurry 23 (see FIG. 4) formed from a mixture of the mixed powder 7, the binder 11, the lubricant 15, and the solvent 19 can be prepared.

(ii) Granular Powder Preparation Step

Figure 4:
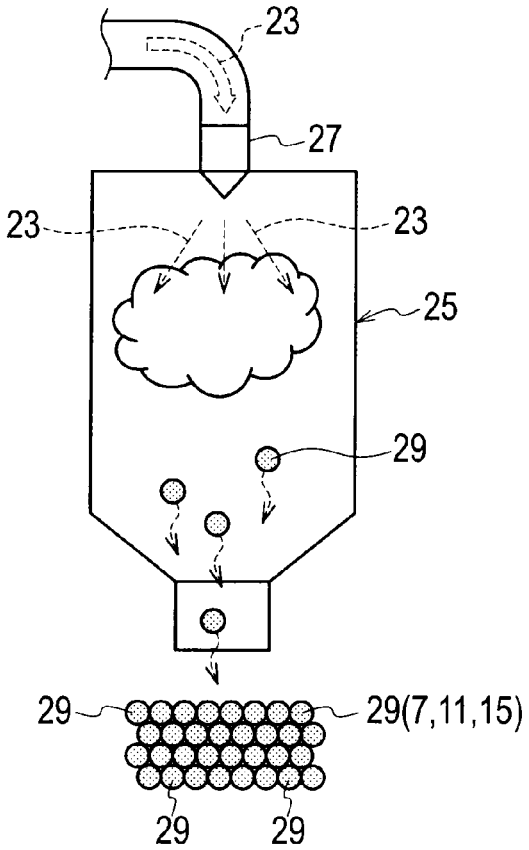
FIG. 4 is a diagram for describing a granular powder preparation step in the method of manufacturing the discharge surface treatment electrode in FIG. 1.

After the completion of (i) the slurry preparation step, granular power 29 is prepared by using a spray drier 25 (an example of a drying apparatus), as shown in FIG. 4. To be specific, the slurry 23 is sprayed from a nozzle 27 of the spray drier 25 into a high-temperature nitrogen gas atmosphere, so that the solvent 19 in the slurry 23 is dried. As a result, the granular powder 29 formed from the mixed powder 7, the binder 11 and the lubricant 15 as well as having spherical particle shapes is prepared.

(iii) Green Compact Preparation Step

Figure 5:
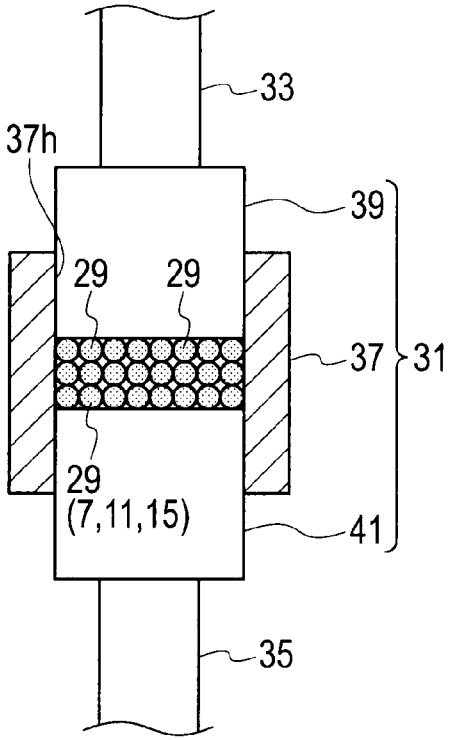
FIG. 5 is a diagram for describing a green compact preparation step in the method of manufacturing the discharge surface treatment electrode in FIG. 1.

After the completion of (ii) the granular powder preparation step, the green compact 9 is prepared using a mold 31, as shown in FIG. 5. To be specific, the granular powder 29 is filled in the mold 31. Then, the mold 31 is pressurized vertically by an upper ram 33 and a lower ram 35 of a press, so that the granular powder 29 inside the mold 31, i.e., the mixed powder 7 inside the mold 31 can be compression-molded into the green compact 9 (see FIGS. 2 and 6).

The mold 31 includes: a cylindrical die 37; an upper punch 39 provided vertically movable in an upper portion of a die hole 37*h* in the die 37, and designed to be pressed downward from above by the upper ram 33 of the press; and a lower punch 41 provided vertically movable in a lower portion of the die hole 37*h* in the die 37, and designed to be pressed upward from below by the lower ram 35 of the press. A contract pressure for the compression of the granular powder 29 is desirably 10 to 30 MPa. Meanwhile, although a desirable density of the green compact 9 varies depending on the kind of the atomization-process/chemical-process metal powder, it is desirably 3 to 4 g/cc in a case of an alloy essentially containing iron, nickel, and cobalt or any of these metals, for example.

(iv) Heat Treatment Step

Figure 6:
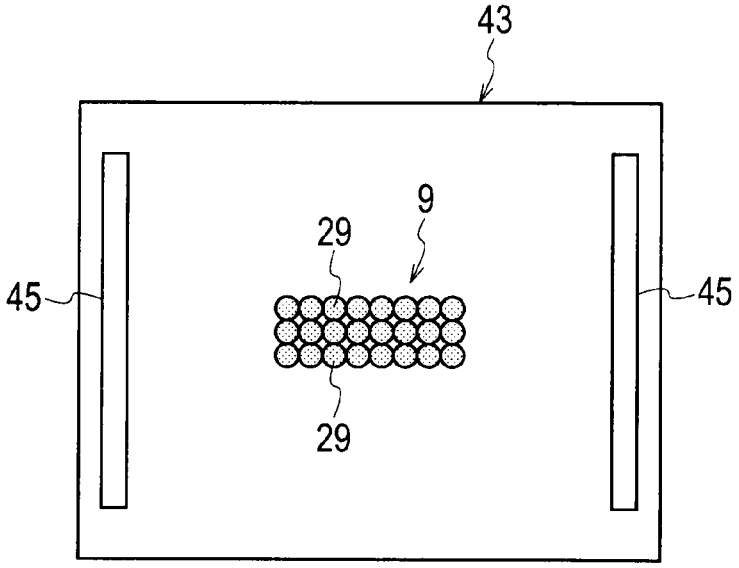
FIG. 6 is a diagram for describing a heat treatment step in the method of manufacturing the discharge surface treatment electrode in FIG. 1.

After the completion of (iii) the green compact preparation step, the green compact 9 is sintered using a vacuum furnace 43 (an example of a furnace), as shown in FIG. 6. To be specific, the green compact 9 is removed from the mold 31, and set at a predetermined position within the vacuum furnace 43. Then, the green compact 9 is sintered by subjecting the green compact 9 to heat treatment in a vacuum atmosphere in the vacuum furnace 43 by use of a heater 45 of the vacuum furnace 43. Although a preferable firing temperature and a preferable firing time vary depending on the kind of the atomization-process/chemical-process metal powder, they are preferably 550° C. to 850° C. and 11 to 13 hours in a case of an alloy essentially containing iron, nickel, and cobalt or any of these metals, for example. Such a firing temperature and a firing time makes it possible to remove the binder 11 and the solvent 15 fully, and therefore to provide an appropriate coupling strength among the powder particles of the green compact 9.

A discharge surface treatment electrode, when used in discharge surface treatment, turns into a film as a result of breaking and melting with the help of pulsed discharge energy. Hence, how easily the electrode breaks due to an electric discharge is an important factor. Then, the firing is preferably performed to such an extent to strengthen the bond among contact portions of power particles of the electrode material with the powder particles keeping their shapes. To be specific, the electric resistance of the fired green compact 9 should preferably be not smaller than $1.0\times10^{-3}$ Ω·cm but smaller than $3.0\times10^{-2}$ Ω·cm approximately, when measured using a four-point probe method specified by the Japanese Industrial Standards (JIS-K-7194). The electric resistance within the range prevents the charging time from becoming too long when the electrode is used as a discharge treatment electrode, thereby enables the electrode to keep up with the frequency of the pulsed electric discharges, and also keeps the thermal conductivity of the electrode at an appropriate level, thereby enables the electrode to keep the temperature of the front end thereof high. Thus, the fired green compact 9 will function preferably as the discharge surface treatment electrode 1.

Note that in the heat treatment step, the heat treatment may be performed in an inert gas atmosphere instead of in the vacuum atmosphere.

Now, operations and effects of the embodiment of the present invention will be described.

In general, in discharge surface treatment using a discharge surface treatment electrode, a film is formed on a treatment target surface of a workpiece by transferring an electrode material onto the workpiece while melting the treatment target surface of the workpiece and the electrode material by use of discharge energy of a pulsed electric discharge which is caused between the electrode and the workpiece in an electrically-insulating liquid or air. Now, let us focus on details of the transfer of the electrode material. Once the electric discharges are caused between the discharge surface treatment electrode and the workpiece, portions of the electrode material are separated from the electrode by blast and an electrostatic force caused by the electric discharges, and shift to a molten or semi-molten state due to the heat of discharge plasma. The separated portions of the electrode material move toward the workpiece while keeping the molten or semi-molten state. Once reaching the treatment target surface of the workpiece, the separated portions of the electrode material re-solidify there. While the pulsed electric discharges continue to be caused by feeding the electrode to the workpiece, the electrode material at the front end of the electrode continuously moves to, accumulates on, and re-solidifies on the workpiece. As a result, a film is formed. Note that, as is sometimes the case, what is formed by a reaction of portions of the electrode material separated from the electrode reacts with a component(s) of the liquid or air reaches and accumulates on the treatment target surface of the workpiece, and is made into a film.

In this respect, not all the portions of the electrode material separated from the electrode can turn into a film on a region of the treatment target surface of the workpiece immediately below the electrode. Some portions of the electrode material separated from the electrode are blown far by shocks of the electric discharges, and flown to regions around the region on the treatment target surface of the workpiece immediately below the electrode. Ground powder ground by a mechanical grinding method using a ball mill, a bead mill, a jet mill or the like is an electrode material that is essential for the electrode to have electric conductivity necessary for the electric discharges, but is particularly likely to be flown far by the energy of plasma caused by the electric discharges. This is because the particle shapes of such powder include flat, scaly shapes and polyhedral shapes with a number of corners. For this reason, it is difficult to increase the deposition efficiency and the film-forming rate in discharge surface treatment using an electrode which contains only such ground powder as its electrode material.

The discharge surface treatment electrode 1 in the embodiment of the present invention contains, as its electrode material, the mixed powder 7 formed from the jet-milled stellite powder with an average particle size of 3 μm or less and the atomization-process/chemical-process metal powder with an average particle size of 3 μm or less. Because of its relatively small specific surface area, the powder manufactured by the atomization process (the atomized powder) is less likely to be flown by the energy of the plasma caused by the electric discharges, and is likely to stay within the plasma. Moreover, the amount of heat necessary for a single electric discharge to locally melt the electrode material is distributed substantially uniformly over the entire electrode, since the average particle size of the jet-milled stellite powder and the average particle size of the atomization-process/chemical-process metal powder are both 3 μm. For this reason, most of portions of the electrode material separated from the electrode 1 reaches the treatment target surface of the workpiece 3 by moving with a uniform flow directed from the electrode 1 to the treatment target surface of the workpiece 3, hence efficiently accumulating and turning into a film on the region immediately below the electrode 1. Accordingly, the discharge surface treatment using the electrode 1 can achieve higher deposition efficiency and a higher film-forming rate. Particularly, the electrode 1 containing approximately 70% by weight of the atomized powder improves the deposition efficiency and film-forming rate by 50% as compared to an electrode containing only ground powder as its electrode material.

Meanwhile, the cost of metal powder prepared by use of a jet mill is generally higher than the cost of metal powder prepared through some other process such as an atomization process. The discharge surface treatment electrode 1 in the embodiment of the present invention contains the mixed powder 7 formed from the jet-milled stellite powder and the atomization-process/chemical-process metal powder as its electrode material, and thus makes it possible to reduce the proportion of the jet-milled powder in the mixed powder 7 as a whole. Accordingly, it is possible to reduce the electrode manufacturing cost of the discharge surface treatment electrode 1.

The strength at an interface between a film and a workpiece (the film's tensile adhesive strength) and the yield by weight were compared between the discharge surface treatment performed using the discharge surface treatment electrode 1 in the embodiment of the present invention and the discharge surface treatment performed using a discharge surface treatment electrode which contains only the jet-milled stellite powder as its electrode material. The interfacial strength and the yield by weight were both found substantially the same between the two cases. Note that the yield by weight means a ratio of the weight of the film formed on the treatment target surface of the workpiece to the weight of the consumed portion of the discharge surface treatment electrode (the weight of formed film/the weight of the consumed portion of the discharge surface treatment electrode).

The embodiment described above is merely an instance described for the purpose of making the present invention understood easily. The present invention is not limited to this embodiment, and may be modified in various ways without departing from the technical scope of the present invention.

EXAMPLES

A discharge surface treatment electrode of Example 1 was obtained by: mixing a jet-milled stellite powder and an atomized stainless-steel (SUS316) powder at a mixture ratio by weight of 3:7 (the atomized stainless-steel powder is 70% by weight); compression-molding the mixed powder into a green compact; and subjecting the green compact to heat treatment. The average particle size and tap density of the jet-milled stellite powder were 1 μm and 0.5 g/cm$^3$, respectively. The average particle size and tap density of the atomized stainless-steel powder were 2.5 μm and 3.5 g/cm$^3$, respectively.

A discharge surface treatment electrode of Example 2 was obtained by: mixing the jet-milled stellite powder and a cobalt powder manufactured through a chemical process at a mixture ratio by weight of 3:7 (the cobalt powder manufactured through the chemical process was 70% by weight); compression-molding the mixed powder into a green compact; and subjecting the green compact to heat treatment. The average particle size and tap density of the jet-milled stellite powder were 1 μm and 0.5 g/cm$^3$, respectively. The average particle size and tap density of the cobalt powder manufactured through the chemical process were 2.5 μm and 2.4 g/cm$^3$, respectively.

A discharge surface treatment electrode of Comparative Example was obtained by: compression-molding the jet-milled stellite powder into a green compact; and subjecting the green compact to heat treatment. The average particle size and tap density of the jet-milled stellite powder were 1 μm and 0.5 g/cm$^3$, respectively.

Films were formed on a treatment target surface of a workpiece on the basis of Example 1, Example 2, and Comparative Example under a predetermined electric discharge condition. In Comparative Example, the thickness of the film formed on the treatment target surface of the workpiece with respect to a predetermined electrode feeding amount of 1 mm was 0.3 mm or less. That is to say, the deposition efficiency was 30% or less. In both Examples 1 and 2, the deposition efficiency was found improved by 50% or higher.

Figure 7:
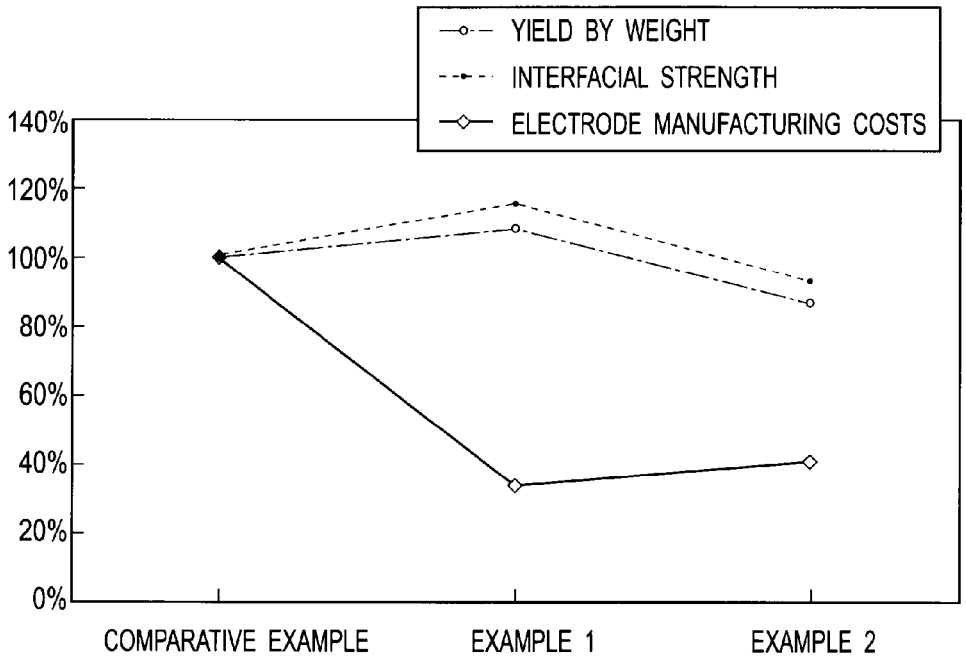
FIG. 7 is a diagram showing a result of an interfacial strength test, a yield by weight, and an electrode manufacturing cost of each example of the present invention.

Next, the interfacial strength was evaluated for each of the films formed based on Example 1, Example 2, and Comparative Example. To do so, an interfacial strength test was conducted on each film in accordance with a method specified by the Japanese Industrial Standards (JIS-H-8402) (Test methods of tensile adhesive strength for thermal-sprayed coatings). The tensile adhesive strength of the film formed in each Example was obtained while using the tensile adhesive strength of the film formed in Comparative Example as a reference strength (100%). FIG. 7 shows the result with a dotted line.

Moreover, the yield by weight was evaluated for the films formed on the treatment target surface of the workpiece on the basis of Example 1, Example 2, and Comparative Example under the predetermined electric discharge condition. The yield by weight of each Example was obtained while using the yield by weight of Comparative Example as a reference yield (100%). FIG. 7 shows the result with a dashed line.

Furthermore, the electrode manufacturing cost of each of Example 1, Example 2, and Comparative Example was obtained while using the manufacturing cost of Comparative Example as a reference cost (100%). FIG. 7 shows the result with a solid line.

It was confirmed from FIG. 7 that while Examples 1 and 2 were at the substantially same level as Comparative Example in terms of the interfacial strength and the yield by weight, Examples 1 and 2 showed significant improvements in the electrode manufacturing cost as compared to Comparative Example. Meanwhile, it was confirmed that: Example 1 was higher than Example 2 in the interfacial strength and the yield by weight; and Example 1 was therefore able to form a high-strength film more efficiently. Moreover, it was confirmed that: Example 1 was lower than Example 2 in the electrode manufacturing cost; and Example 1 therefore provided a more economical electrode.

Furthermore, since Example 1 used a stainless steel having a higher melting point than cobalt as the electrode material, Example 1 made it possible to inhibit the sinterability of the green compact 9 as compared to that in Example 2, and accordingly to raise the sintering temperature of the green compact 9 to 700 to 800° C. It was confirmed that: Example 1 was thus able to remove residues of the additives (the binder 11 and the lubricant 15) from the discharge surface treatment electrode 1 more securely than Example 2; and Example 1 was accordingly able to make the density of the discharge surface treatment electrode 1 more uniform than otherwise, and thus to improve the homogeneity of the film 5.

In addition, a wear resistance test conducted on the films formed using the discharge surface treatment electrodes of Example 1, Example 2, and Comparative Example confirmed that the wear resistances of the films in Examples 1 and 2 were at the substantially same level as that in Comparative Example.

INDUSTRIAL APPLICABILITY

The discharge surface treatment electrode of the present invention enables the formation of a film at higher deposition efficiency and a higher film-forming rate while maintaining the interfacial strength and yield by weight of the film, and therefore achieves excellent productivity. In addition, the discharge surface treatment electrode of the present invention is low in the electrode manufacturing cost, and thus is economically friendly. Accordingly, the discharge surface treatment electrode of the present invention can be utilized preferably in various situations such as when a discharge surface treatment is performed to form wear-resistant films or the like on turbine blades of an aircraft gas turbine engine, an automobile turbocharger, or an automobile supercharger.

The invention claimed is:

1. A method of manufacturing a discharge surface treatment electrode used in discharge surface treatment for forming a wear-resistant film on a treatment target surface of a workpiece by using discharge energy of an electric discharge caused between the electrode and the workpiece, the wear-resistant film being made of a material of the electrode or a substance obtained by a reaction of the material of the electrode with the discharge energy, the method comprising:

a slurry preparation step of preparing a slurry by mixing at least a powder of a Stellite alloy having a non-spherical particle shape with an average particle size of 3 μm or less prepared by use of a jet mill, a powder of a metal having a substantially spherical particle shape with an average particle size of 3 μm or less manufactured through an atomization process or a chemical process, and a solvent, wherein a mixing ratio by weight of the powder of the Stellite alloy having the non-spherical particle shape to the powder of the metal having the substantially spherical particle shape is within a range from 5:5 to 1:9;

a granular powder preparation step of preparing granular powder by drying the solvent in the slurry after the slurry preparation step;

a green compact preparation step of compression-molding a green compact out of the granular powder after the granular powder preparation step; and a heat treatment step of sintering the green compact by subjecting the green compact to heat treatment after the green compact preparation step.

2. The method of manufacturing a discharge surface treatment electrode of claim 1, wherein the metal is a pure metal.

3. The method of manufacturing a discharge surface treatment electrode of claim 1, wherein the metal is any of iron, cobalt, nickel, copper, chromium, and molybdenum.

4. A method of manufacturing a discharge surface treatment electrode used in discharge surface treatment for forming a wear-resistant film on a treatment target surface of a workpiece by using discharge energy of an electric discharge caused between the electrode and the workpiece, the wear-resistant film being made of a material of the electrode or a substance obtained by a reaction of the material of the electrode with the discharge energy, the method comprising:

a slurry preparation step of preparing a slurry by mixing at least a powder of a Stellite alloy having a non-spherical particle shape with an average particle size of 3 μm or less prepared by use of a jet mill, a powder of a metal having a substantially spherical particle shape with an average particle size of 3 μm or less manufactured through an atomization process or a chemical process, and a solvent;

a granular powder preparation step of preparing granular powder by drying the solvent in the slurry after the slurry preparation step;

a green compact preparation step of compression-molding a green compact out of the granular powder after the granular powder preparation step; and a heat treatment step of sintering the green compact by subjecting the green compact to heat treatment after the green compact preparation step, wherein the metal is an alloy.

5. The method of manufacturing a discharge surface treatment electrode of claim 4, wherein the metal is any of an iron-based alloy, a cobalt alloy, and a nickel alloy.

6. The method of manufacturing a discharge surface treatment electrode of claim 4, wherein the metal is a stainless steel.

* * * * *